United States Patent [19]

Ihara

[11] 4,280,517

[45] Jul. 28, 1981

[54] BRUSH ATTACHMENT TO HAIR DRESSER

[75] Inventor: Sinji Ihara, Hikone, Japan

[73] Assignee: Matsushita Electric Works, Ltd., Osaka, Japan

[21] Appl. No.: 23,775

[22] Filed: Mar. 26, 1979

Related U.S. Application Data

[60] Continuation of Ser. No. 769,711, Feb. 17, 1977, abandoned, which is a division of Ser. No. 602,907, Aug. 7, 1975.

[30] Foreign Application Priority Data

Aug. 16, 1974 [JP] Japan ..... 49-94508

[51] Int. Cl.[3] ..... A45D 20/00

[52] U.S. Cl. ..... 132/9

[58] Field of Search ..... 132/9, 85, 40, 33 R; 15/179, 202

[56] References Cited

U.S. PATENT DOCUMENTS

| | | | |
|---|---|---|---|
| 1,137,184 | 4/1915 | Brugger | 15/179 X |
| 2,672,147 | 3/1954 | Freeland | 132/33 R |
| 2,753,583 | 7/1956 | Jepson | 15/179 X |
| 3,530,863 | 9/1970 | Foster | 132/33 R |
| 3,599,345 | 8/1971 | Tolmie | 132/9 |
| 3,981,314 | 9/1976 | Barradas | 34/97 |
| 4,023,578 | 5/1977 | Buhler | 132/33 R |

*Primary Examiner*—G. E. McNeill

*Attorney, Agent, or Firm*—Burns, Doane, Swecker & Mathis

[57] ABSTRACT

An attachment including a plurality of brushes to hair dressers for performing curling treatment with respect to hairs wound around the attachment with hot or cool air stream blown from a dresser body. The attachment comprises a substantially hollow cylindrical base part to be fitted at an end to air blowoff end of the dresser body and a pillar-shaped brush body part extending from the other end of the base part and having the brushes planted on radial ribs defining between them air-stream guiding channels extending over the length of the brush body part and communicated with the air blowoff end of the dresser body through the base part, and a substantially cylindrical cover of a thermally conductive material fitted over the brush body part to the base part while allowing the brushes to extend partly in their length out of the cover through at least a plurality of air ventilating apertures provided in the cover. The hairs wound cylindrically on the cover as held by the extending brushes and prevented from being entangled on planted root portions of the brushes by the cover are effectively disposed to a heat transmitted from the air stream through the thermally conductive cover and also directly to the air stream blown out of the ventilating apertures.

2 Claims, 5 Drawing Figures

BRUSH ATTACHMENT TO HAIR DRESSER

This is a continuation of application Ser. No. 769,711, filed Feb. 17, 1977, now abandoned, the latter being a division of application Ser. No. 602,907, filed Aug. 7, 1975.

This invention relates to brush attachments to hair dressers and, more particularly, to improvements in the brush attachments having radially planted brushes and fitted to an air blowoff end of a dresser body for achieving curling treatment of hairs wound substantially cylindrically onto the brushes.

In conventional hair dressers, the brush attachment comprising an elongated brush body and a plurality of brush bristles planted to the periphery of the body is fitted to an air blowoff end of dresser body which including cool or hot air blowing means and hairs are wound around the brush body so as to be held by the brushes substantially in a cylindrical shape so that the hairs will be treated to be curled by the air blown from the dresser body inside the cylindrically wound hairs. Specifically in the case when the hairs to be treated are fine and soft, however, the hairs wound to planted root portions of the brush bristles are likely to be entangled so that the entangled hairs may cause the blown air prevented from smoothly penetrating through the wound hairs and, when the entangled hairs are unwound after the treatment, the user will have to feel a pain. The present invention has been suggested to solve such defects of conventional brush attachments, by providing a brush attachment to hair dressers wherein a thermally conductive cover of a substantially elongated cylindrical shape is fitted to the brush body so that at least the outer periphery of the cover will be positioned between the root portions and tip portions of the respective brushes.

A primary object of the present invention is, therefore, to provide a brush attachment to hair dressers wherein a brush body is covered on the outer peripheral surface from which the brushes extend with a thermally conductive cover so as to prevent wound hairs from directly reaching the root portions of brushes of the brush body and from being entangled on the root portions of the brushes and to render the hair dresser convenient and comfortable to use.

Another object of the present invention is to provide a brush attachment to hair dressers wherein a cover of a thermally conductive material or specifically a metal is fitted to a brush body, whereby thermal transmission area with respect to the hairs wound on the attachment can be made larger, causing the dresser to be improved in thermal transmitting efficiency and thus in hair curling effect.

A further object of the present invention is to provide a brush attachment to hair dressers employing a brush body high in air-blowing opening degree and thus high in ventilation performance.

According to the brush attachment of the present invention, as hairs are not entangled on the roots of brushes, it is convenient and comfortable to use and, as the wound hairs contact a thermally conductive cover heated by hot air, it is so high in the thermal transmission performance that the hairs can be well curled.

Other objects and advantages of the present invention shall be made clear in the following disclosures thereof detailed with reference to a preferred embodiment shown in accompanying drawings, in which.

Figure 1:
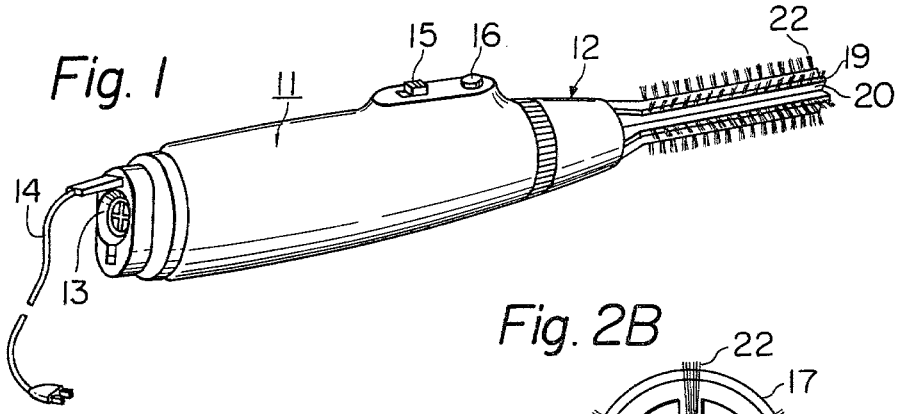
FIG. 1 is a perspective view of an exemplary hair dresser to which only a brush body of an embodiment of the attachment of the present invention is applied.

While the present invention will now be explained in the followings with reference to the preferred embodiment shown in the drawings, it should be understood that the present invention is not to be limited to the particular embodiment but is to include all alterations, modifications and equivalent arrangements included in the scope of appended claims of the present invention.

Referring now to FIG. 1, a brush body 12 of a brush attachment according to the present invention is fitted to an air blowoff end of a dresser body 11 in which an electric heater, motor and fan (not illustrated) are provided. The dresser body 11 has at the other end an air intake 13 and current source cord 14 preferably detachably connected to the heater and motor and on the periphery of substantially tubular body a switch 15 for operating the motor and fan and a push button 16 for operating the heater to switch air stream blown by the fan to be hot or cool. The brush body 12 according to the present invention is removable from the dresser body 11, and its removed state is shown in FIG. 2A.

Figure 2B:
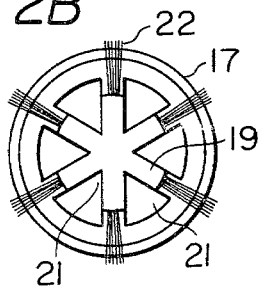
FIGS. 2A and 2B are respectively a perspective view and a longitudinal endwise plan view of the brush body shown in FIG. 1.
Figure 2A:
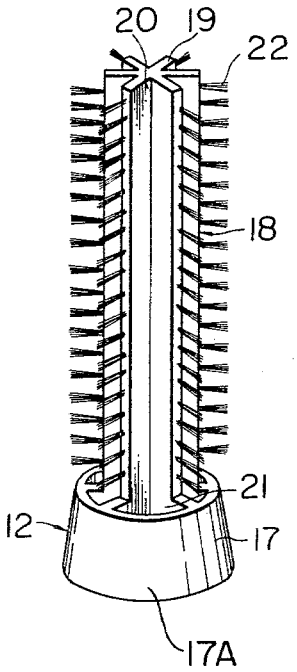

Referring next to FIGS. 2A and 2B, the brush body 12 comprises a base part 17 and pillar-shaped part 18 which are coaxially integrally made of a resinous material. The pillar-shaped part 18 has a plurality of ribs 19 projecting in radial directions from longitudinal axis of the part 18 as separated from each other in the peripheral direction and extending in the axial direction, so that substantially V-shaped air guiding channels 20 will be provided beween the respective ribs 19. These channels 20 are communicated respectively with each of discharging holes 21 which are made through the base part 17 to communicate in turn with the air blowoff end of the dresser body 11. A plurality of brushes 22 are planted on top edge surface of the respective ribs 19 substantially over the entire length thereof at regular intervals.

Figure 2C:
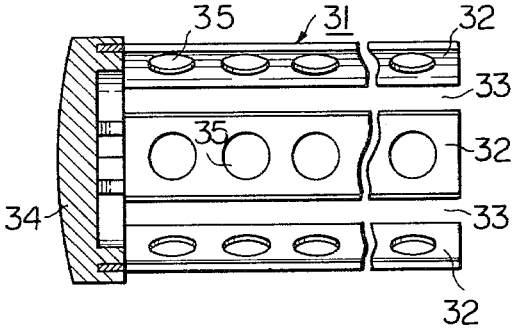
FIG. 2C is a longitudinally sectioned view as partly omitted of an embodiment of thermally conductive cover to be fitted to the brush body of FIG. 1 according to the present invention.

In FIG. 2C, there is shown in section a thermally conductiver cover 31 which can be fitted to the brush body 12 shown in FIGS. 2A and 2B. This thermally conductive cover 31 is made of such metal as aluminium, iron, brass or the like and include a plurality of segments 32 arcuated in section and extending in the axial direction in the illustrated embodiment and arranged so as to be cylindrical in the outline. It will be appreciated that segments of other shapes may be used so as to be of another outline such as, for example, a prismatic outline. The respective segments 32 are held integral at their outer ends by a disk-shaped base member 34 as separated from each other forming an air gap between respective adjacent ones of them so that, when the cover 31 is fitted to the brush body 12, the brushes 22 on each rib 19 will be positioned in each of such air gap and extend partly out of the cylindrical outline. The number of the segments 32 as well as the air gaps 33 is equal to the number of the ribs 19 provided on the brush body 12.

Figure 3:
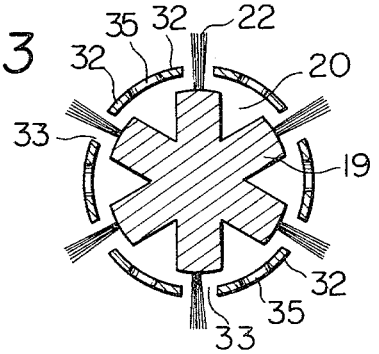
FIG. 3 is a transversely sectioned view of the brush attachment with the brush body and cover fitted to the body respectively of FIGS. 1 and 2.

According to an important feature of the present invention, as will be made clear with reference to FIG. 3, the thermally conductive cover 31 when fitted to the brush body 12 will be positioned with the outline of the cover 31 between the root portions and the tip portions of the respective brushes 22 planted on the brush body 12, that is, the root portions of the brushes 22 will be positioned inside the cover 31 as separated therefrom by a considerable amount of distance.

According to a further feature of the present invention, the brush attachment is so formed as to elevate the thermal transmission performance from the hot or cool air stream guided through the channels 20 to the hairs wound around the brush body 12. That is, the respective segments 32 of the cover 31 are arcuately formed of a thermal conductor so as to be, for example, well heated by the hot air which hitting the inside surfaces of the segments 32 and to show a high thermal transmissibility for the hairs brought into contact with the respective segments 32. The arcuate inside surfaces of the respective segments 32 are very advantageous to be heated or cooled by the air stream fed from the dresser body 11.

According to another feature of the present invention, the brush attachment 12 is so formed that, even if hairs are wound on the cover 31, a sufficient ventilation will be insured. That is, many through holes 35 separated in the axial direction are provided in the respective segments 32 of the cover 31, whereby the air stream delivered out of the dresser body 11 will flow out of the cover 31 not only through the air gaps 33 between the respective segments 32 but also through the holes 35 and thereby the air ventilation through the wound hairs will be able to be kept favorable.

Free or inner ends of the respective segments 32 on the side opposed to the base 34 of the thermally conductive cover 31 are resiliently fitted over the tapered periphery 17A of the base part 17 of the brush body 12 so as to be removably snap-fitted to the base part. In such state, the air stream discharged through the discharging holes 21 in the base part 17 of the brush body 12 will reach the inside surface of the substantially cylindrical cover 31 through the channels 20 and, when the hairs are wound on the outer peripheral surface of the cover 31 as held by the brushes 22, the air stream will hit the inside surfaces of the respective segments 32 and will be further caused to pass through the wound hairs from the air gaps 33 and through holes 35.

In such case, the roots of the brushes 22 will be well separated from the outside surface of the cover 31 so that the hairs will not be caused to be entangled on the roots of the brushes 22. Further, it will be readily understood that the respective segments 32 of the cover 31 will be in contact with hairs in a range wider than in the case of conventional dressers so that, when the respective segments 32 are heated by hot air, heat will be transmitted to the hairs not only directly from the hot air stream but also favorably from the cover 31. Further, such double heat transmission as above will ensure that the intended hair curling effect will be well even with respect to the hairs wound on the cover at a high density, through which the air stream will be also well urged to penetrate through the gaps and holes without being impaired by such density.

What is claimed is:

1. A brush attachment to a hair dresser which includes air blowing means, air heating means and an air stream blowoff port at one end of said dresser, said attachment comprising a brush body having a base and a plurality of axially extending, circumferentially spaced ribs projecting from said base, said ribs defining therebetween a plurality of axial air guiding channels, and a plurality of rows of brushes having root portions planted in said ribs such that each of said rows extends in the axial direction of said brush body for holding hair wound around the brush body, said brushes having radially extended tip portions, said brush body being removably attachable to said one end of said hair dresser, said base of said attachment including surface means tapering in a direction away from said brushes, and a cover formed of a thermally conductive material and having a plurality of brush-receiving slits extending in the axial direction of said cover, an inner end of said cover being removably attachable to said base, said slits being open at said inner end of said cover to define therebetween a plurality of resilient arc-shaped segments which are resiliently expandable during longitudinal sliding movement of said segments along said tapering surface means to connect said cover to said base, said cover being dimensioned such that upon being inserted over said brush body, the periphery of the cover is positioned between said planted root portions and said tip portions of the brushes while allowing the brushes to extend from the cover through said slits, and a space communicating between said air stream blowoff port of the hair dresser and said root portions of said brushes, said slits dividing said cover into a plurality of segments of thermally conductive material overlying respective ones of said channels so that the segments are heated by air from said channels and conduct such heat to hair wound around said segments.

2. A brush attachment according to claim 1, wherein each of said segments include a plurality of through-holes which are spaced in a longitudinal direction parallel to said slits, said cover including a base disposed transversely of the longitudinal direction and located at said outer end of said body when said cover is attached to said brush body so as to close-off said air guiding channels, said air guiding channels being longitudinally open at said outer end of said brush body when said cover is removed.

* * * * *